US009783384B2

(12) United States Patent
Ward

(10) Patent No.: US 9,783,384 B2
(45) Date of Patent: Oct. 10, 2017

(54) BI-MODAL ROLLERS

(71) Applicant: Crane Payment Innovations, Inc., Malvern, PA (US)

(72) Inventor: Thomas F. Ward, Downingtown, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 0 days.

(21) Appl. No.: 15/087,954

(22) Filed: Mar. 31, 2016

(65) Prior Publication Data

US 2016/0289035 A1 Oct. 6, 2016

Related U.S. Application Data

(60) Provisional application No. 62/141,090, filed on Mar. 31, 2015.

(51) Int. Cl.

| | |
|---|---|
| ***G07F 7/04*** | (2006.01) |
| ***B65H 23/038*** | (2006.01) |
| ***B65H 29/00*** | (2006.01) |

(52) U.S. Cl.

CPC ..... *B65H 23/038* (2013.01); *B65H 29/006* (2013.01); *B65H 2301/41912* (2013.01); *B65H 2404/1313* (2013.01); *B65H 2404/1314* (2013.01); *B65H 2404/13163* (2013.01); *B65H 2404/252* (2013.01); *B65H 2701/1912* (2013.01)

(58) Field of Classification Search

CPC ..... B65H 23/038; B65H 23/04; B65H 23/06; B65H 23/063; B65H 27/00; B65H 2404/131; B65H 2404/1311; B65H 2404/1313; B65H 2404/1314; B65H 2404/13163

See application file for complete search history.

(56) References Cited

U.S. PATENT DOCUMENTS

| | | | | |
|---|---|---|---|---|
| 3,412,950 | A * | 11/1968 | Martin, Sr. | B65H 18/20 242/542.4 |
| 4,557,613 | A | 12/1985 | Tallian et al. | |
| 5,341,664 | A | 8/1994 | Noe et al. | |
| 6,978,816 | B1 * | 12/2005 | Byrne | B65H 19/1836 156/157 |
| 8,792,794 | B2 | 7/2014 | Okuno | |
| 8,820,737 | B2 | 9/2014 | Dobrindt | |
| 8,899,582 | B2 | 12/2014 | Saito et al. | |
| 8,903,289 | B2 | 12/2014 | Yu et al. | |
| 2014/0248484 | A1 * | 9/2014 | Bormann | A61F 13/15731 428/220 |
| 2015/0001795 | A1 | 1/2015 | Furusawa | |

* cited by examiner

*Primary Examiner* — Mark Beauchaine

(57) ABSTRACT

An apparatus includes a bi-modal roller configured to rotate about a longitudinal axis of the bi-modal roller. The bi-modal roller includes two ends and a rolling outer surface. The rolling outer surface is divided into a convex portion and concave portion. The concave portion includes at least one concave curve extending longitudinally between the two ends. The concave portion is configured to, when a film physically contacts the concave portion, affect translation of the film in response to a stick condition or a slip condition. The convex portion includes at least one convex curve extending longitudinally between the two ends. The convex portion is configured to, when the film physically contacts the convex portion, affect translation of the film in response to a stick condition or a slip condition.

21 Claims, 15 Drawing Sheets

BI-MODAL ROLLERS

CROSS-REFERENCE TO RELATED APPLICATION(S) AND CLAIM OF PRIORITY

This application claims priority under 35 U.S.C. §119(e) to U.S. Provisional Patent Application No. 62/141,090 filed on Mar. 31, 2015. The above-identified provisional patent application is hereby incorporated by reference in its entirety.

TECHNICAL FIELD

This disclosure relates generally to web tracking systems. More specifically, this disclosure relates to a bi-modal roller implementation within a web tracking system or other system.

BACKGROUND

Web tracking systems often include a film and a roller that operate together to drive movement of a document in a feed direction or a rejection direction. These types of web tracking systems can be used in a variety of ways, such as in monetary banknote and document handling systems.

SUMMARY

This disclosure provides a bi-modal roller implementation within a web tracking system or other system.

In a first embodiment, an apparatus includes a bi-modal roller configured to rotate about a longitudinal axis of the bi-modal roller. The bi-modal roller includes two ends and a rolling outer surface. The rolling outer surface is divided into a convex portion and concave portion. The concave portion includes at least one concave curve extending longitudinally between the two ends. The concave portion is configured to, when a film physically contacts the concave portion, affect translation of the film in response to a stick condition or a slip condition. The convex portion includes at least one convex curve extending longitudinally between the two ends. The convex portion is configured to, when the film physically contacts the convex portion, affect translation of the film in response to a stick condition or a slip condition.

In a second embodiment, a system includes first and second bi-modal rollers forming a pair of bi-modal rollers. Each bi-modal roller is configured to rotate about a longitudinal axis of the bi-modal roller. Each bi-modal roller includes two ends and a rolling outer surface divided into a convex portion and a concave portion. The concave portion includes at least one concave curve extending longitudinally between the two ends. The concave portion is configured to, when a film physically contacts the concave portion, affect translation of the film in response to a stick condition or a slip condition. The convex portion includes at least one convex curve extending longitudinally between the two ends. The convex portion is configured to, when the film physically contacts the convex portion, affect translation of the film in response to a stick condition or a slip condition. The pair of bi-modal rollers are configured to independently rotate without contacting each other.

In a third embodiment, a web tracking system includes first and second bi-modal rollers forming a pair of cooperating bi-modal rollers. The pair of cooperating bi-modal rollers are configured to independently rotate without contacting each other. Each bi-modal roller is configured to rotate about a longitudinal axis of the bi-modal roller. Each bi-modal roller includes two ends and a rolling outer surface. The rolling outer surface is divided into a convex surface portion and a concave surface portion. The concave portion includes at least one concave curve extending longitudinally between the two ends. The concave portion is configured to, when a film physically contacts the concave portion, affect translation of the film in response to a stick condition or a slip condition. The convex portion includes at least one convex curve extending longitudinally between the two ends. The convex portion is configured to, when the film physically contacts the convex portion, affect translation of the film in response to a stick condition or a slip condition. The web tracking system also includes at least one film wrapped around at least part of each of the rollers in the pair of cooperating bi-modal rollers. The at least one film includes the film. The at least one film is configured to move a banknote in multiple directions based on different rotations of the pair of cooperating bi-modal rollers.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of this disclosure may be implemented in any suitably arranged device or system.

In a web tracking system, such as one where a long length of a thin film extends from a spool to a drum, consistent side-to-side placement of the film on rollers can be important. For example, a web tracking system could measure the speed of a film using a series of holes in the middle of the film. If the film moves too far to the left or right of center, the system may not sense the holes, thereby reducing or preventing effective control of the film's speed. A web tracking system may also include an interface for optimal note transition, and the interface may include castellations from various sub-assemblies. As a result, gates in a transport module could pierce the film if the film moves too far to the left or right.

At most locations within a web tracking system, the side-to-side position of a film can be controlled either by flanges on guide rollers or stationary walls of material. Where banknotes encounter the films, such as at the entrance to drums, characteristics of a gap between the films are such that flanges or walls of plastic are not practical, for example in the case of the guide rollers. Accordingly, guide rollers or stationary walls of material allow the film to track off the center of the rollers.

In accordance with this disclosure, roller geometry is used to control the tracking of a film. In many instances, interactions between roller geometry and a film can be summarized by two basic rules: (1) if the film sticks to the roller, a convex roller geometry is preferred and (2) if the film slips over the roller, a concave roller geometry is preferred. One conventional solution to control the tracking of a film is to guarantee or otherwise continuously maintain a stick condition of the film to a roller, such as when a web tracking system includes bearings and a high coefficient of friction surface on the rollers. However, these features (the bearings and high friction surface rollers) are subject to wear and particle contamination and may lose their effectiveness over time. Another conventional solution to control the tracking of a film is to guarantee a purely slip condition of the film on a roller, such as when a web tracking system includes rollers fixed in place. However, wear of the film is a potential problem in this situation. In sum, since a web tracking system including either a purely stick condition or purely slip condition could not be guaranteed without adverse wear effects, this disclosure provides another solution, namely a bi-modal roller, within a web tracking system.

Figure 1A:
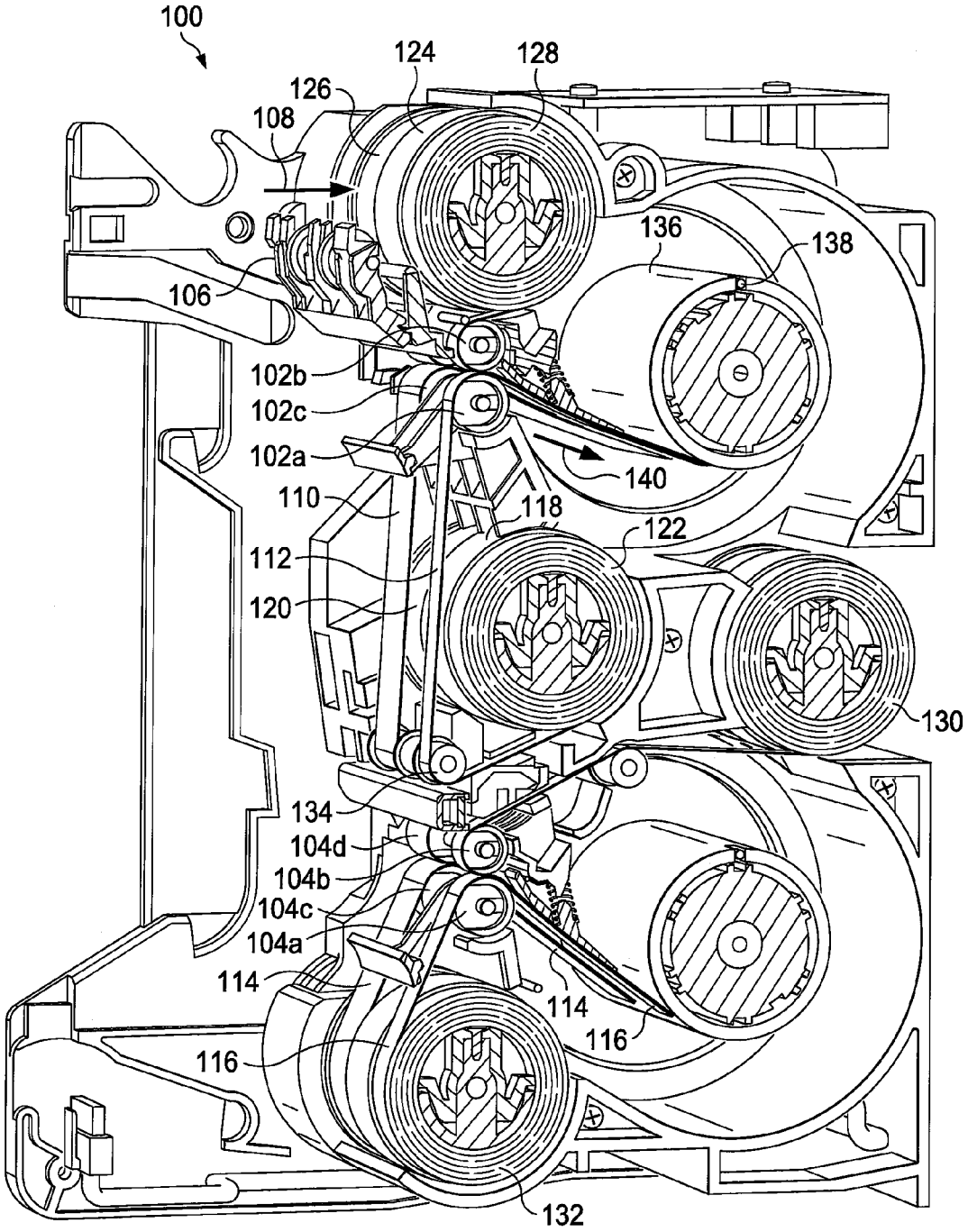
FIGS. 1A through 1D illustrate various views of an example web tracking system implementing a bi-modal roller in accordance with this disclosure.
Figure 1B:
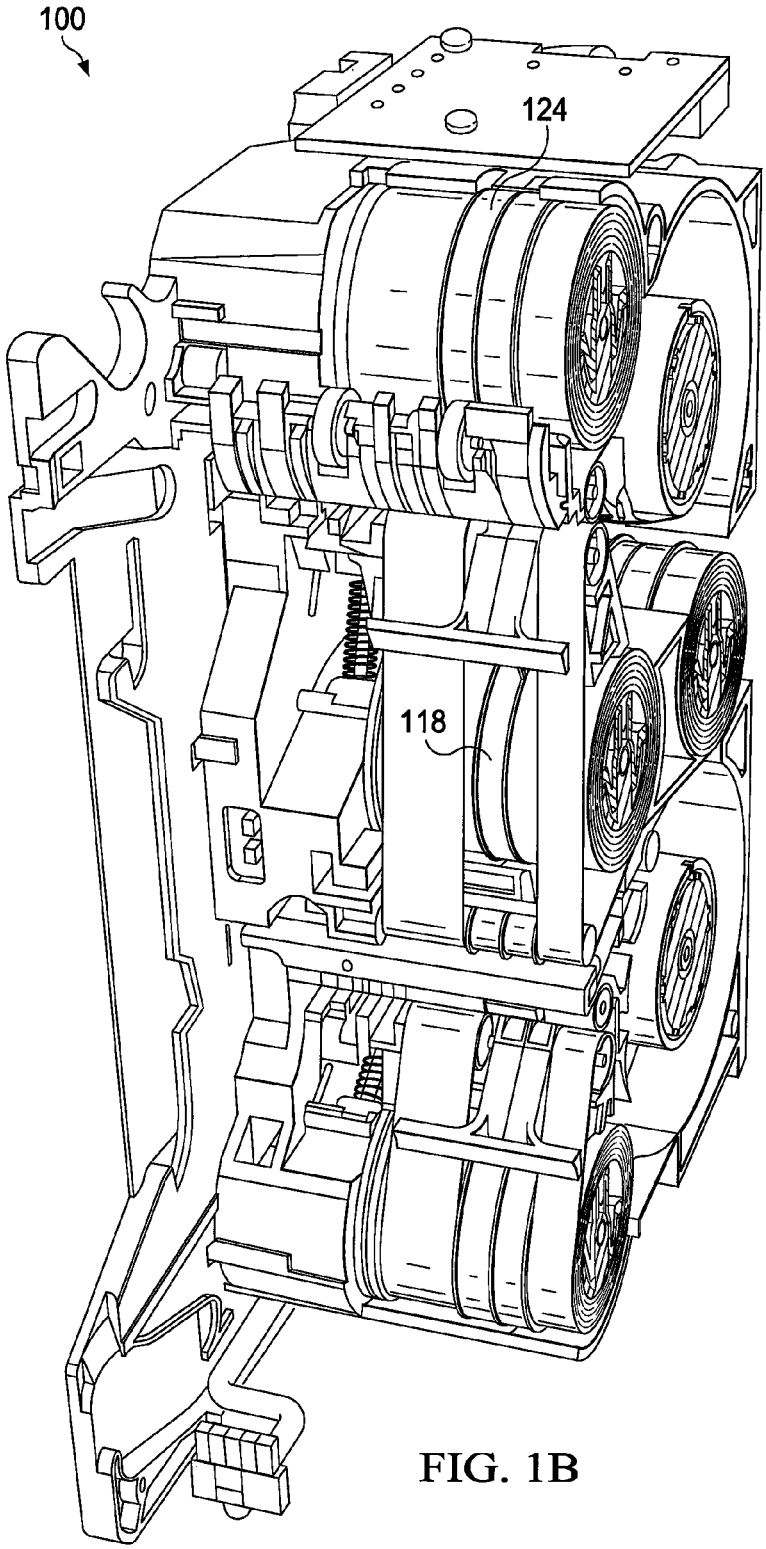
Figure 1C:
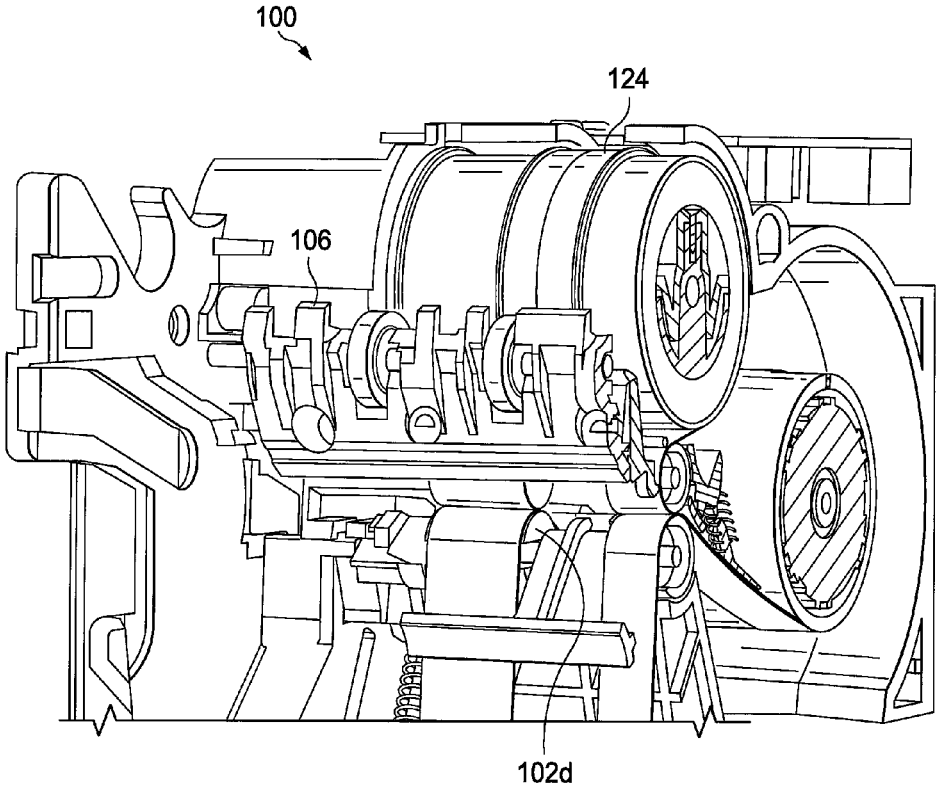
Figure 1D:
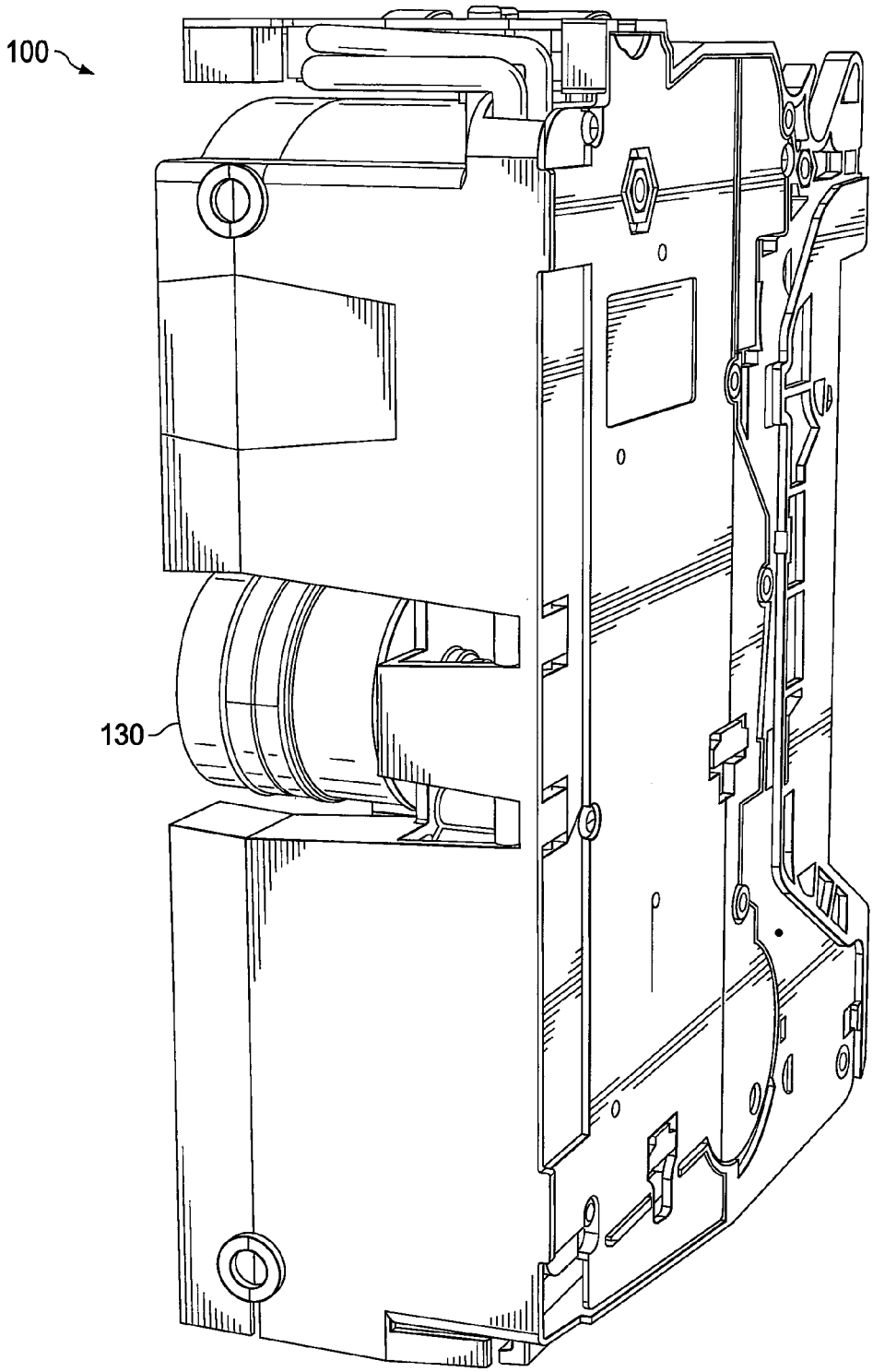
Figure 1E:
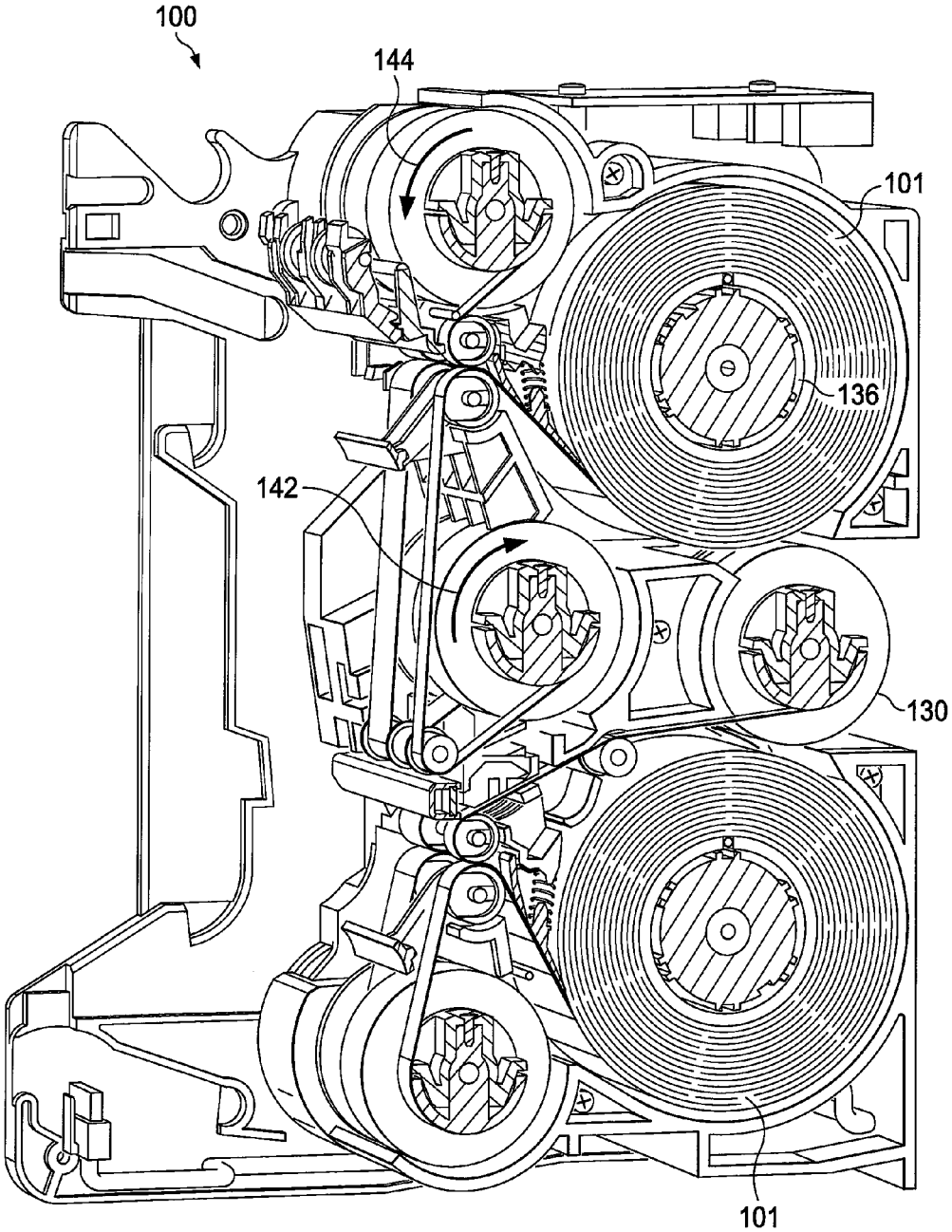
FIG. 1E illustrates the web tracking system of FIG. 1A with banknotes stored on a drum in accordance with this disclosure.

FIGS. 1A through 1E illustrate various views of an example web tracking system 100 implementing a bi-modal roller in accordance with this disclosure. In particular, FIGS. 1A through 1D illustrate a front-left perspective view, a left perspective view, an up-close left perspective view, and a rear-right perspective view of the web tracking system 100. In FIGS. 1A through 1D, no banknotes are shown, yet FIG. 1E illustrates the web tracking system 100 of FIG. 1A with banknotes 101 stored on a drum in accordance with this disclosure. This embodiment of the web tracking system 100 is for illustration only. Other embodiments of a web tracking system could be used without departing from the scope of this disclosure. The web tracking system 100 can be included within a banknote recycler, such as the banknote recycler 800 in FIG. 8 or the banknote recycler 900 in FIG. 9.

As shown in FIGS. 1A through 1E, the web tracking system 100 includes one or more bi-modal rollers 102*a*-102*d* and 104*a*-104*d*. The bi-modal roller 102*d* is visible in the view shown in FIG. 1C. Each roller 102*a*-102*d* and 104*a*-104*d* rotates about an axis, and some rollers rotate about a common axis. For example, the rollers 102*a* and 102*c* share an axis of rotation, the rollers 102*b* and 102*d* share an axis of rotation, the rollers 104*a* and 104*c* share an axis of rotation, and the rollers 104*b* and 104*d* share an axis of rotation.

Each roller 102*a*-102*d* and 104*a*-104*d*, in response to a stick condition or a slip condition of a web in physical contact with the roller, affects translation of the web by controlling lateral movement of the web. The term "web" may refer to one or more film(s) herein. Each roller 102*a*-102*d* and 104*a*-104*d* cooperates with another roller in a pair of cooperating rollers to enable films to form a pinch, which is used to transport a banknote along a path that passes through a gap in between the pair of cooperating rollers. An example of cooperating pairs of rollers include rollers 102*a*-102*b*, rollers 102*c*-102*d*, rollers 104*a*-104*b*, and rollers 104*c*-104*d*. One or more cooperating pairs of rollers form a set of rollers that together with at least one web translate a banknote in a desired direction. One example set of rollers in the web tracking system 100 includes two pairs of rollers 102*a*-102*b* and 102*c*-102*d*, and another set of rollers in the web tracking system 100 includes two pairs of rollers 104*a*-104*b* and 104*c*-104*d*. Details of example bi-modal rollers are provided below with reference to FIG. 4, FIGS. 6A-6F, and FIG. 7. For simplicity, features of the first the set of rollers 102*a*-102*d* will be described in further detail below, and these features apply to the other set of rollers 104*a*-104*d*.

The web tracking system 100 also includes a banknote recycler interface 106, such as an intake/removal interface. When a banknote is inserted into the banknote recycler interface 106, the banknote recycler interface 106 moves the banknote in the direction of an arrow 108 to provide physical contact between the banknote and a film within the web tracking system 100. As used herein, references to a banknote may also refer to a treasury note, bill, ticket, cash, money, bank-draft, promissory note, coupon, check (personal, cashier, travelers, and the like), currency, bond, drafts and documents of value (paper, metal, polymer, and the like), or a combination thereof, and the like. In this embodiment, the web tracking system 100 includes two film pairs, namely films 110-112 in a first pair and films 114-116 in a second pair. Other numbers of films can be used without departing from the scope of this disclosure. Movement of the banknote in the direction of the arrow 108 causes physical contact between the banknote and the films 110-112 in the first pair.

The web tracking system 100 further includes motor drive wheels that rotate about an axis according to a drive direction (clockwise or counterclockwise) of a corresponding motor within the web tracking system 100. Each film 110-116 is physically connected to and wound around two motor drive wheels forming two spools per film. More particularly, one end of each film is secured to one motor drive wheel, an opposite end of each film is secured to another motor drive wheel, and the two motor drive wheels work together to wind or unwind the film. For example, a motor drive wheel 118 rotates in one direction to wind the films 110-112 onto respective spools 120-122, and a motor drive wheel 124 rotates in an opposite direction to unwind the films 110-112 from respective spools 126-128. The motor drive wheel 124 also rotates in one direction to wind the films 110-112 onto the spools 126-128, and the motor drive wheel 118 rotates in the opposite direction to unwind the films 110-112 from the spools 120-122. Similarly, other motor drive wheels rotate in opposite directions of each other to wind and unwind the films 114-116 to and from spools 130-132.

For simplicity, features of the film 112 and its pair of cooperating rollers 102*a*-102*b* will be described in further detail. The described features of the film 112 apply to the other films 110, 114, 116. Specifically, each film 110-116 wraps around and rotates a respective pair of cooperating rollers 102*a*-102*b*, 102*c*-102*d*, 104*a*-104*b*, and 104*c*-104*d*.

From the spool 122 to the spool 128, the film 112 defines a path by wrapping around a series of cylinders, a pin, and a pair of cooperating rollers 102*a*-102*b*. Specifically, the path of the film 112 includes a positively sloped portion that wraps or otherwise turns around a portion of a cylinder 134 to form a vertical portion, which wraps around a portion of the roller 102*a* to form one of two negatively sloped anti-parallel portions. The path of the film 112 continues by wrapping around substantially half of an interior surface of the cylinder 136 in a counter-clockwise direction to a pin 138 disposed within an opening of the cylinder 136, such as at the "12 o'clock" position. Through the opening of the cylinder 136, a banknote can move from a location of being carried by the film 112 (namely, a location proximate the interior surface of the cylinder 136) to a storage location in a banknote recycler drum (referred to by reference character 202 of FIG. 2). The storage location surrounds the exterior surface of the cylinder 136. The path of the film 112 wraps around the pin 138 and continues by wrapping around the same half of the exterior surface cylinder 136 in a clockwise direction. From there, the path of the film 112 forms another negatively sloped anti-parallel portion, which wraps around a portion of the roller 102*b* to turn into a positively sloped direction and extend to the spool 128.

The two negatively sloped anti-parallel portions of the film 112 face each other and form a pinch. The pinch can be in a gap disposed between the pair of cooperating rollers 102*a*-102*b*. To form the pinch, the two anti-parallel portions physically touch each other in order to grip a banknote. The surfaces of the film 112 that grip the banknote enable the web tracking system 100 to move the banknote either (i) into a banknote recycler drum in the direction of an arrow 140 or (ii) out of the banknote recycler drum in a direction opposite the arrow 140. For example, the portions of the film 112 disposed in the gap can traverse through the gap in opposite linear directions of each other, which forces a banknote to traverse through the gap in a first linear direction toward the banknote recycler drum. That is, the portion of the film 112 wrapped around the roller 102*a* establishes surface-to-surface contact with one side of the banknote and moves in the direction of the arrow 140. Meanwhile, the portion of the film 112 wrapped around the roller 102*b* establishes surface-to-surface contact with the opposite side of the banknote and moves in an opposite direction of the arrow 140.

Note that this disclosure is not limited by two negatively sloped anti-parallel portions within the path of a film that forms a pinch. Rather, the path of a film that forms the pinch can include any suitable relationship between portions that physically contact each other and that move in opposite directions within the gap between a pair of cooperating rollers.

The web tracking system 100 is configured such that the film 112 maintains physical contact with both rollers 102*a*-102*b* and applies force to their outer surfaces to rotate the rollers 102*a*-102*b*. More particularly, in response to a motor rotating the motor drive wheel 118 in the clockwise direction, the roller 102*a* rotates in the clockwise direction because the portion of the film 112 wrapped around the roller 102*a* applies friction to the surface of the roller 102*a* as that portion of the film 112 moves in the direction of the arrow 140. Also, in response to a motor rotating the motor drive wheel 124 in the counter-clockwise direction, the roller 102*b* rotates in the clockwise direction because the portion of the film 112 wrapped around the roller 102*b* applies friction to the surface of the roller 102*b* as that portion of the film 112 moves in the opposite direction of the arrow 140. In this example, the pair of corresponding rollers 102*a*-102*b* rotate in the same direction, but this disclosure is not limited by this feature. The physical contact between the film 112 and the roller 102*a* can be a stick condition or a slip condition. As the outer surface of each cooperating roller 102*a*-102*b* can have multiple shapes, a single revolution of the roller 102*a*-102*b* can affect or compensate for both stick and slip conditions at different times with the film 112.

As shown in FIG. 1E, several banknotes 101 are stored in the banknote recycler drum (referred to by reference character 202 of FIG. 2), surrounding the exterior surface of the cylinder 136. More particularly, several banknotes 101 are stored on the banknote recycler drum 202 of the upper portion of the web tracking system 100, and another group of several banknotes 101 are stored on the banknote recycler drum of the lower portion of the web tracking system 100. Also, as describe more particularly below, a motor can drive the motor drive wheel 118 in a clockwise direction of rotation (as indicated by the arrow 142) and drive the motor drive wheel 124 in an opposite direction of rotation (as indicated by the counterclockwise direction arrow 144), unwinding the films 110-112 from the spools 126-128 and winding the films 110-112 onto the spools 120-122.

Figure 2:
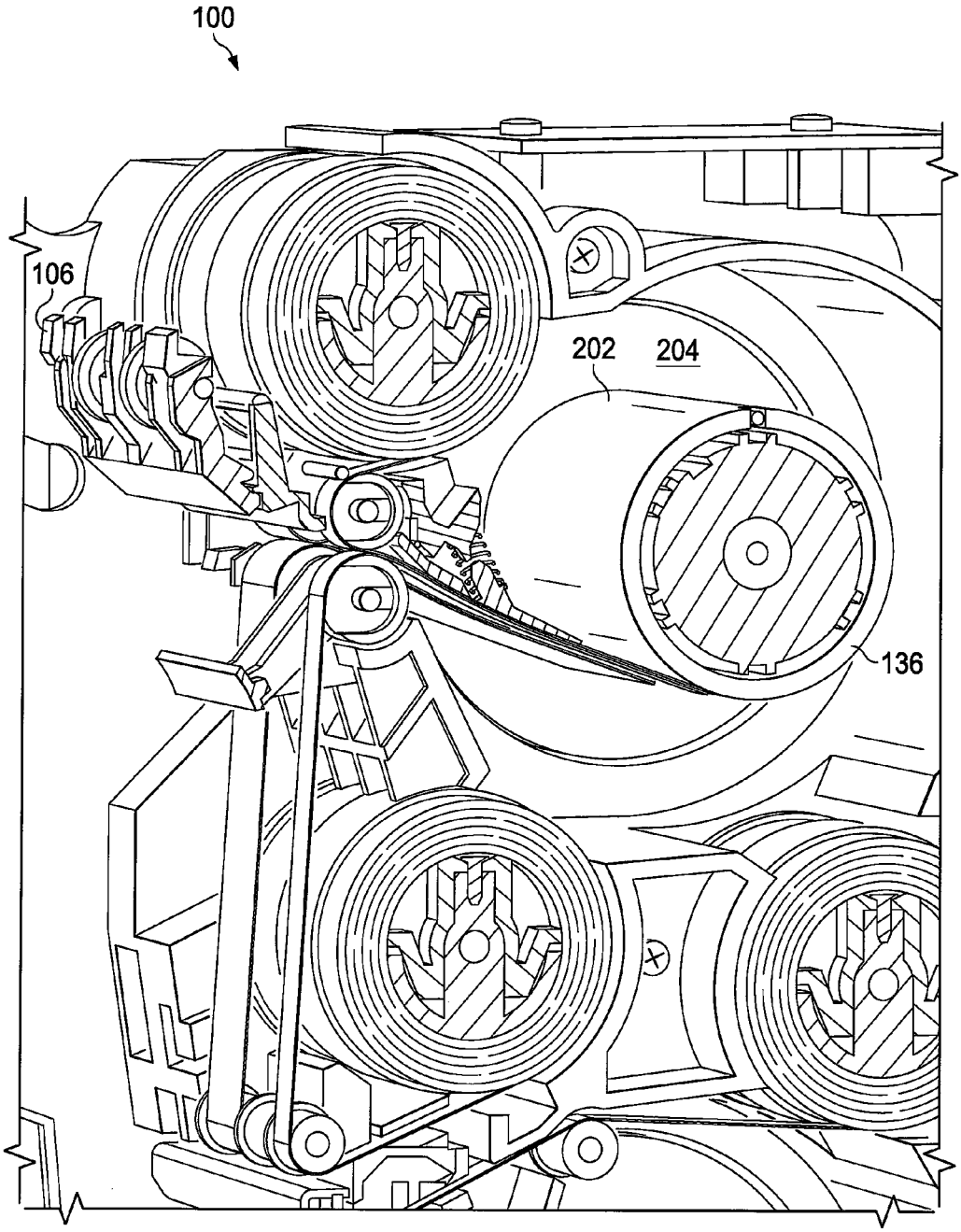
FIG. 2 illustrates a portion of the web tracking system of FIGS. 1A through 1E in accordance with this disclosure.

FIG. 2 illustrates a portion of the web tracking system 100 of FIGS. 1A through 1E in accordance with this disclosure. In particular, FIG. 2 illustrates the upper portion of the web tracking system 100 in greater detail. In FIG. 2, the banknotes 101 are hidden from view, or the banknote recycler drum 202 is empty. The banknote recycler drum 202 includes the cylinder 136 and the flange 204 of the cylinder 136, but the drum 202 is not limited to these portions. When banknotes 101 are stored on the banknote recycler drum 202, a portion of the flange 204 is hidden from view by the stored banknotes.

Figure 3:
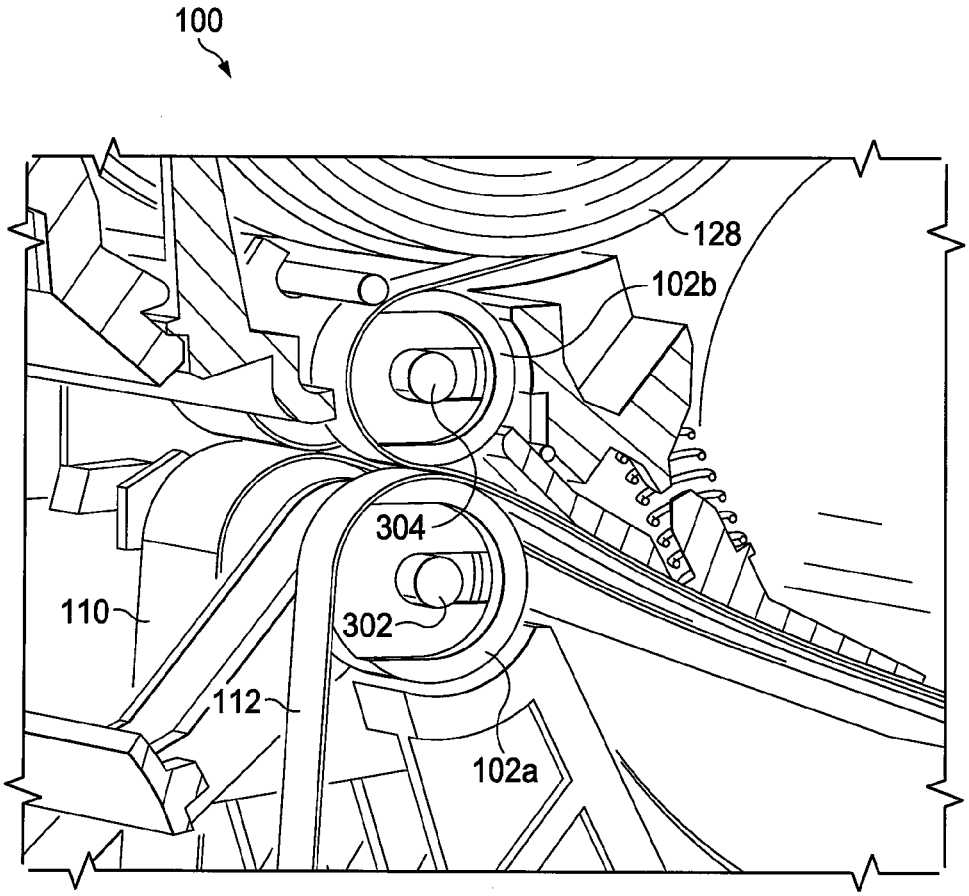
FIG. 3 illustrates a pair of rollers of the web tracking system of FIGS. 1A through 1E in accordance with this disclosure.

FIG. 3 illustrates a pair of rollers 102*a*-102*b* of the web tracking system 100 of FIGS. 1A through 1E in accordance with this disclosure. As shown in FIG. 3, the roller 102*a* is larger than the roller 102*b* such that the radius of the roller 102*a* is larger than the radius of the roller 102*b*, so the rollers 102*a*-102*b* can rotate at different speeds. However, the relative sizes of the rollers 102*a*-102*b* are for illustration only.

The rollers 102*a* and 102*c* rotate about a common shaft 302, and the rollers 102*b* and 102*d* rotate about a common shaft 304. In some embodiments, the rollers 102*a* and 102*c* are the same size as each other, and the rollers 102*b* and 102*d* are the same size as each other. Accordingly, a uniform gap width can be formed between the rollers on the shaft 302 and the rollers on the shaft 304.

Figure 4:
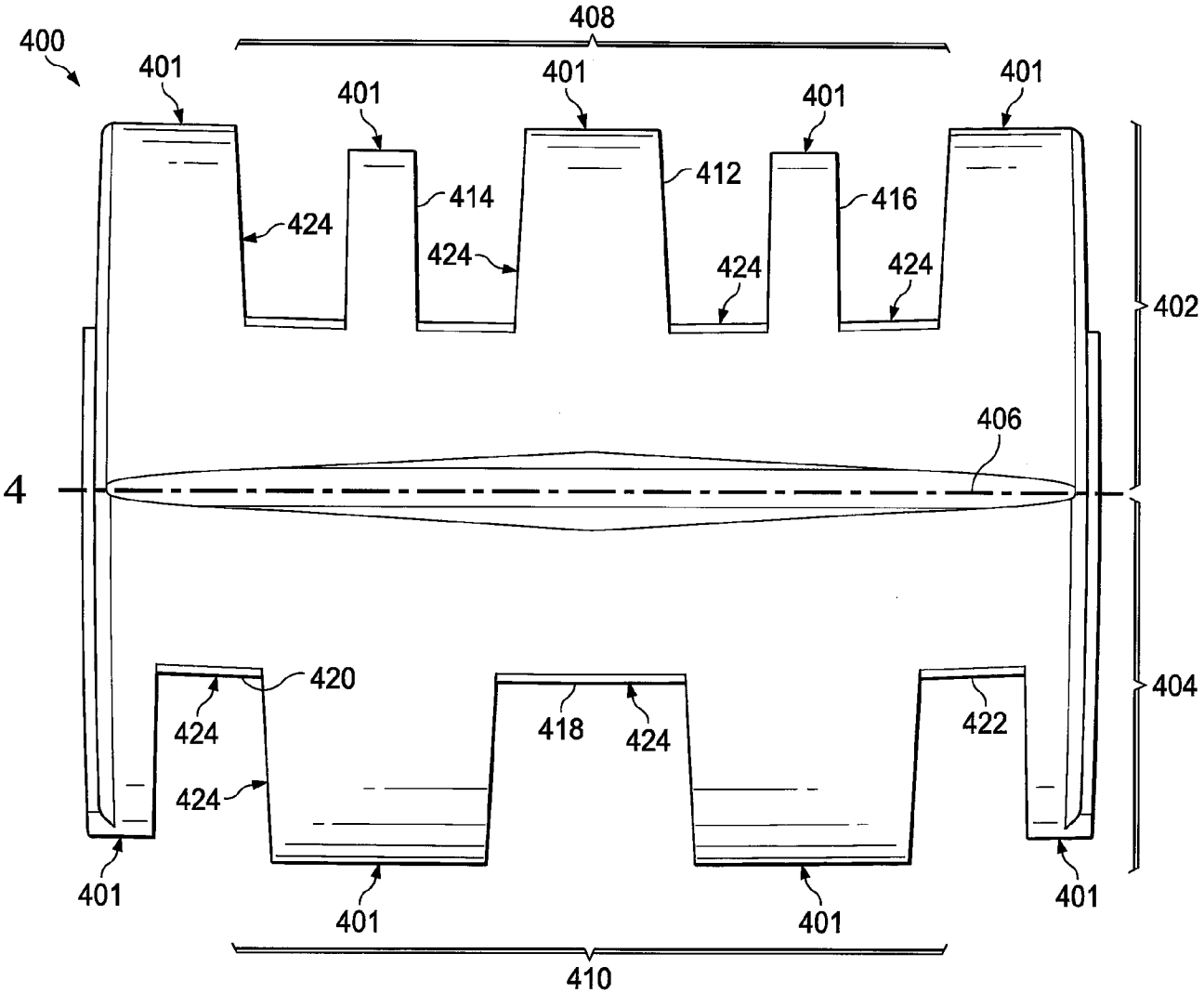
FIG. 4 illustrates an example bi-modal roller in accordance with this disclosure.

FIG. 4 illustrates an example bi-modal roller 400 in accordance with this disclosure. The embodiment of the bi-modal roller 400 shown in FIG. 4 is for illustration only. Other embodiments could be used without departing from the scope of this disclosure.

Note that bi-modal roller 400 of FIG. 4 could be the same as or similar to corresponding bi-modal rollers 102*a*-102*d* and 104*a*-104*d* in FIGS. 1A-1E. These components in FIG. 4 can operate in the same or similar manner as the corresponding components in FIG. 1.

As shown in FIG. 4, the bi-modal roller 400 includes a round cylindrical structure with a center bore. The bi-modal roller 400 can be composed from any suitable material, such as metal, plastic, wood, or other suitable material. The outer surface, namely, the rolling outer surface 401 of the bi-modal roller 400 includes a concave portion and another portion that is a convex portion. Here, the bi-modal roller 400 includes a concave half 402 and a convex half 404 to control web tracking. That is, the bi-modal roller 400 is divided such that the concave half 402 does not occupy a same angular position as the convex half 404. While the concave and convex portions are split into substantially equal halves, is not a requirement, but instead an example. The bi-modal roller 400 can be divided in any suitable way such that the concave portion occupies a different angular position than the convex portion.

With this design, for substantially half a revolution of the roller, the film/roller interaction follows the two basic rules described above, regardless of the stick or slip condition. The concave half 402 reduces the amount of time that the film slips over the bi-modal roller 400, thereby reducing wear of the film. The convex half 404 reduces the amount of time that the film sticks to the bi-modal roller 400, thereby enabling the bi-modal roller 400 to have a reduced coefficient of friction on its outer surface compared to the high coefficient of friction of an outer surface or roller that provides the purely stick condition. As a higher surface coefficient of friction is related to particle contamination and wear of the film and roller, the bi-modal roller 400 provides technical advantages of reduced contamination, reduced film wear, and reduced roller wear.

The bi-modal roller 400 rotates about its longitudinal axis 406. A cross-sectional view of the roller 400 would show that the center bore extends the entire length of the roller 400 along the longitudinal axis 406. The center bore can be a hole in the round cylindrical structure; the hole extends from one base of the round cylindrical structure to the other base of the round cylindrical structure; and the hole extends along the longitudinal center axis of the round cylindrical structure. The center bore is configured to allow a shaft to pass through without resistance. The center bore can have any suitable shape, such as a circular cylinder.

The bi-modal roller 400 also includes multiple castellations. Here, the concave half 402 includes castellations 408, and the convex half 404 includes castellations 410. In some embodiments, the concave half 402 includes a larger quantity of narrower castellations 408, and the convex half 404 includes a smaller quantity of wider castellations 410 than the concave half 402. The rolling outer surface 401 of the bi-modal roller 400 includes an outer surface of the castellations 408, 410. The castellations 408 of the concave half can form multiple concave curves at a same angular position of the bi-modal roller. Alternatively, the castellations 408 could together form a single concave curve. Also, the castellations 410 of the convex half 404 can together form a single concave curve, or alternatively could together form multiple convex curves at a same angular position of the bi-modal roller. The castellations 408 include four notches disposed between five posts. The notches can have any suitable size and shape, such as a trapezoid. The notches can be equally spaced from each other or spaced at regular or irregular intervals. A center post 412 and two outer posts are wider than two inner posts 414-416. The center post 412 is also taller than the two inner posts 414-416. In some embodiments, the center post 412 is shorter than the two outer posts, forming one concave curvature of the concave half 402. As such, the single concave curve is disposed at the angular position of the single curve. In other embodiments, the center post 412 has the same height as the outer posts, forming separate concave curvatures on each side of the center post 412. As such, the multiple concave curves are disposed at the same angular position of the bi-modal roller.

The castellations 410 include three notches disposed between four posts. The inner posts are taller than the outer posts, forming the convex curvature between the outer posts. The notches can be equally spaced from each other or spaced at regular or irregular intervals. Also, the center notch 418 can be wider than two outer notches 420-422. Each notch defines an inner surface 424 of the constellations 408 and 410.

Although FIG. 4 illustrates one example bi-modal roller 400, various changes may be made to FIG. 4. For example, the bi-modal roller 400 could be a hollow body in an embodiment, or could be a solid body in another embodiment. For example, the bi-modal roller could be divided in to a number of concave portions and a number convex portions, namely positive numbers of each. That is, the bi-modal roller could be divided in to multiple concave portions, multiple convex portions, or both. The film/roller interaction for every revolution of the bi-modal roller would include a number of stick conditions matching the number of concave portions and would include a number of slip conditions matching the number of convex portions. When the number of concave portions is equal to the number of number convex portions, the film/roller interaction of every revolution of the bi-modal roller would include a quantity of stick conditions equal to the quantity of slip conditions. When 50% of the bi-modal roller is dedicated to the number of concave portions, and the 50% of the bi-modal roller is dedicated to the number of convex portions, the advantages of reduced film wear and reduced roller wear could be even. The tradeoff between film wear reduction versus roller wear reduction can be controlled by a ratio of (i) the percentage of the outer surface of the bi-modal roller dedicated to the number of concave portions to (ii) the percentage of the outer surface of the bi-modal roller dedicated to the number of convex portions. In FIG. 4, this ratio is one, but in other embodiments, the ratio can be within a range (e.g. substantially one) that is determined by design needs.

Figure 6A:
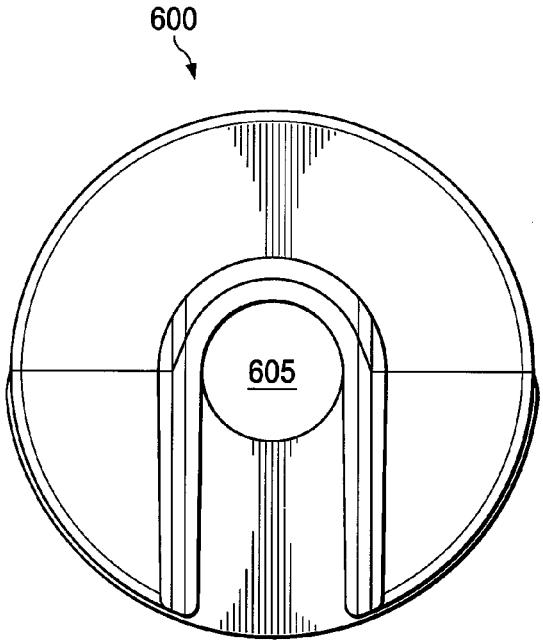
FIGS. 6A-6F illustrate various views of an example bi-modal roller in accordance with this disclosure.
Figure 6B:
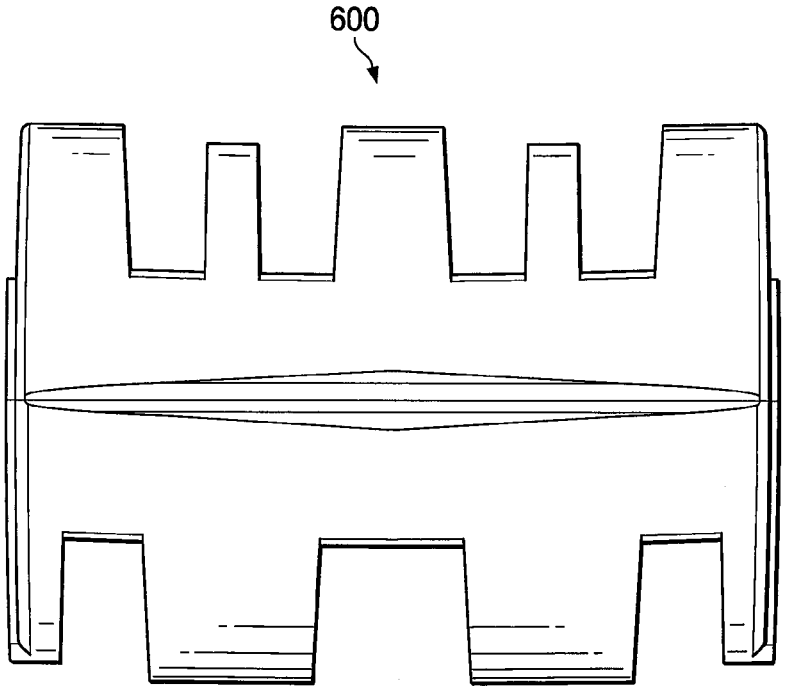
Figure 6C:
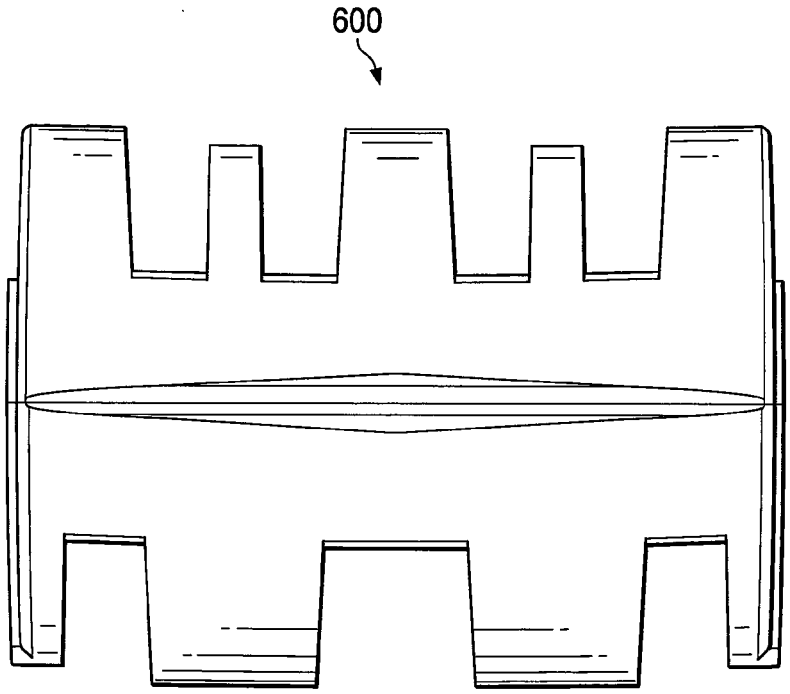
Figure 6D:
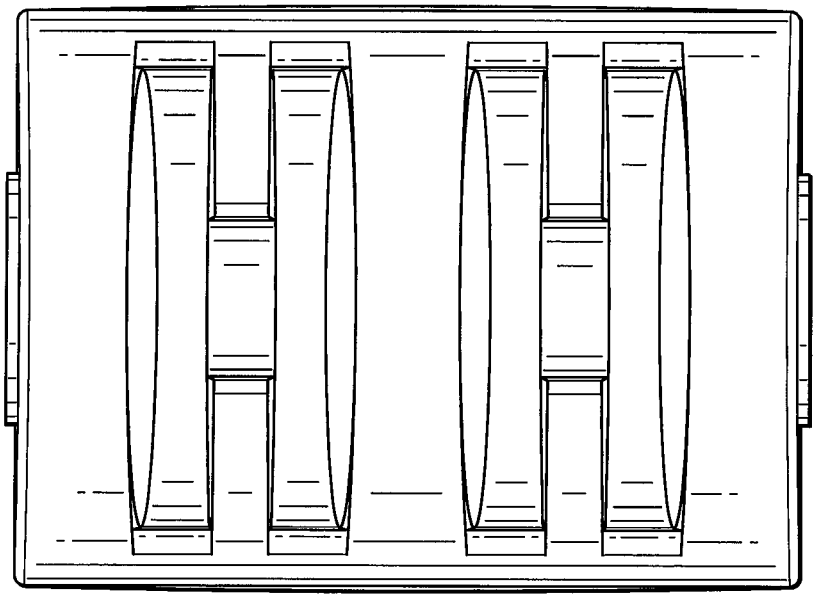
Figure 6E:
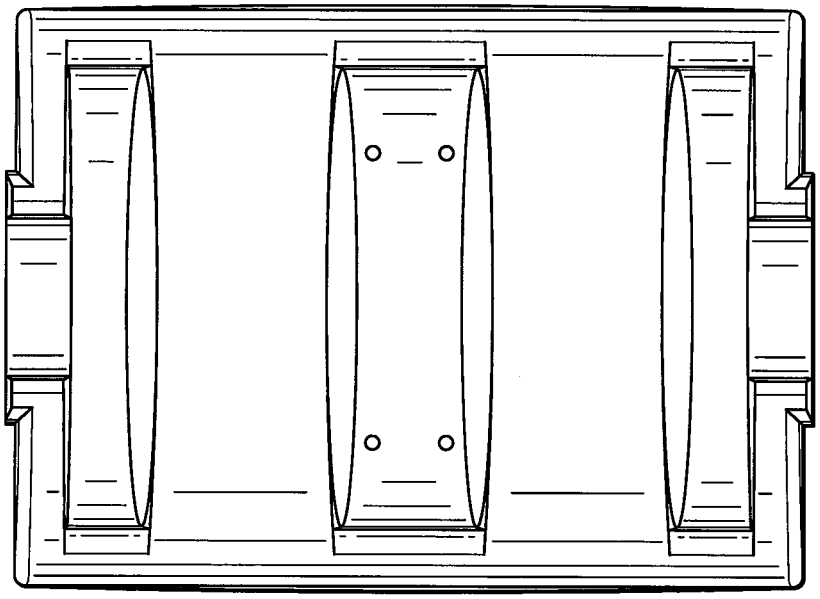
Figure 6F:
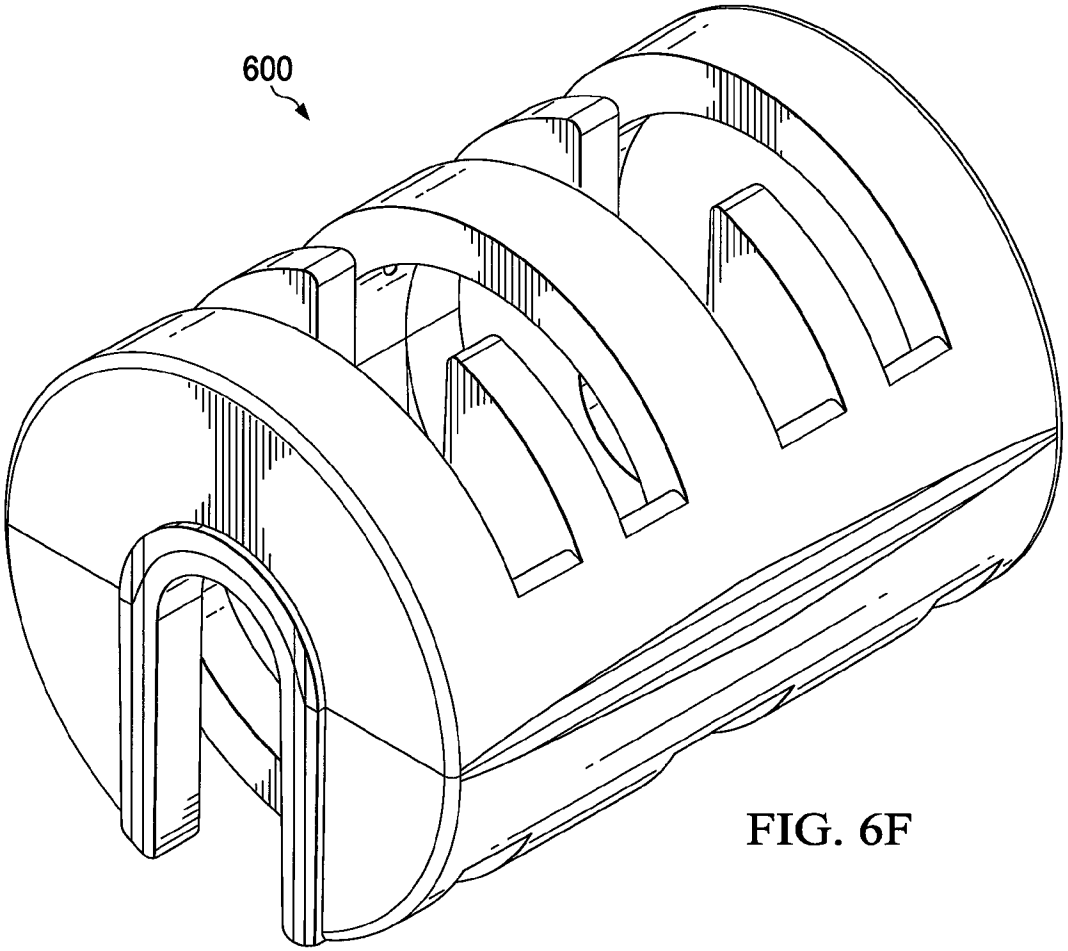

FIGS. 6A-6F illustrate various views of an example bi-modal roller 600 for intake in accordance with this disclosure. FIG. 6A illustrates a front view of the bi-modal roller 600, and the center bore 605 is clearly depicted. FIGS. 6B and 6C illustrate left and right views of the bi-modal roller 600. FIG. 6D illustrates a top view of the bi-modal roller 600. FIG. 6E illustrates a bottom view of the bi-modal roller 600. FIG. 6F illustrates an orthogonal view of the bi-modal roller 600. The embodiment of the bi-modal roller 600 shown in FIGS. 6A-6F are for illustration only. Other embodiments could be used without departing from the scope of this disclosure.

The embodiment of the bi-modal roller 600 can be a 12-millimeter bi-modal roller for intake, and can represent the bi-modal roller 102*a*. In this example, the side view (left or right view in FIGS. 6B and 6C) shows that the length of the bi-modal roller is larger than the diameter.

Another embodiment of the bi-modal roller 600 can be a 10-millimeter bi-modal roller for intake. As an example, the 10-millimeter bi-modal roller can represent the bi-modal roller 102*b*. Note that the design and dimensions of the roller 600 in FIGS. 6A-6F are for illustration only.

Figure 5:
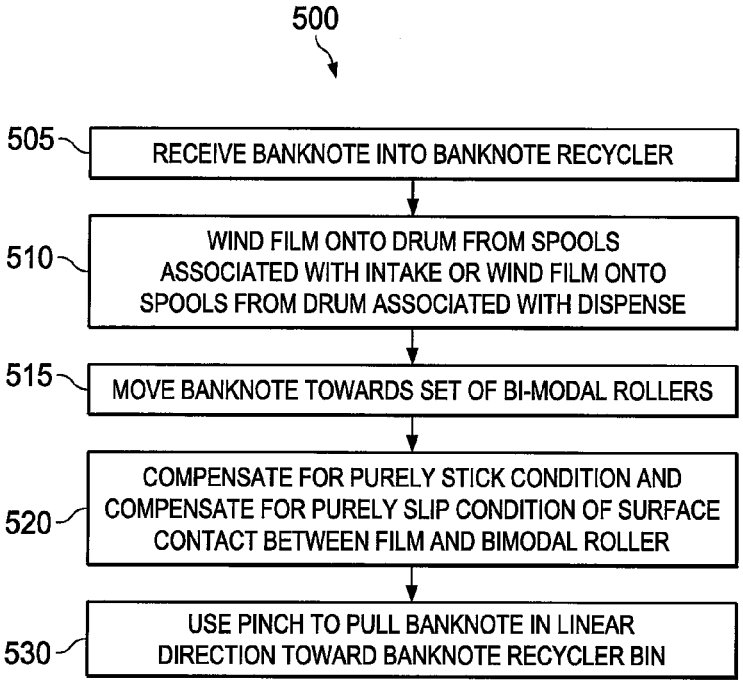
FIG. 5 illustrates an example method for controlling a side-to-side position of a film in a web tracking system in accordance with this disclosure.

FIG. 5 illustrates an example method 500 for controlling a side-to-side position of a film in a web tracking system in accordance with this disclosure. The embodiment of the method 500 shown in FIG. 5 is for illustration only. Other embodiments could be used without departing from the scope of this disclosure.

The method 500 could be implemented or otherwise controlled by a computerized controller. In certain embodiments, the controller includes executable instructions stored in a machine-usable, computer-usable, or computer-readable medium in any of a variety of forms, wherein the instructions, when executed, cause the processing circuitry of the controller to controlling a side-to-side position of a film in a web tracking system. The processing circuitry could, for instance, include at least one processor, microprocessor, microcontroller, field programmable gate array (FPGA), application specific integrated circuit (ASIC), or other processing or control device.

In block 505, the banknote recycler receives a banknote. For example, the banknote can be insertably received into the banknote recycler though a slot such that the banknote can be detected at the banknote recycler interface 106. In response to the detection, the banknote recycler moves the banknote at the banknote recycler interface to provide physical contact between the banknote and films 110-112 within the web tracking system 100.

In block 510, the web tracking system 100 winds film onto the banknote recycler drum from spools associated with intake of the banknote. For example, a motor can drive the motor drive wheel 118 in a clockwise direction of rotation (as indicated by the arrow 142 of FIG. 1E) and drive the motor drive wheel 124 in an opposite direction of rotation (as indicated by the counterclockwise direction arrow 144 of FIG. 1E), unwinding the films 110-112 from the spools 126-128 and winding the films 110-112 onto the spools 120-122. As an example, the controller of the web tracking system 100 can be configured to control the motors based on signals indicating whether to (i) intake the banknote along a path toward a banknote recycler drum in order to store the received banknote, or to (ii) remove the banknote from the web tracking system 100. That is, in block 510, the web tracking system 100 can wind film onto the banknote recycler drum from spools associated with dispense of the banknote. Removal of the banknote could also refer to an operation to dispense, unload, or return the banknote, or other like operations. Removal of the banknote includes moving the banknote along the path in an opposite direction of the intake, namely, in a direction from storage in the banknote recycler drum to where banknotes are inserted or otherwise received into the banknote recycler. For example, in performing a removal operation, the motor can drive the motor drive wheel 118 in a counterclockwise direction of rotation (opposite direction of arrow 142) and drive the motor drive wheel 124 in an opposite, clockwise direction of rotation (opposite direction of arrow 144).

In block 515, the web tracking system 100 moves the banknote toward a set of bi-modal rollers 102*a*-102*d*. For example, the banknote recycler interface 106 and the motor drive wheel 124 can work together to move the banknote into a gap disposed between the bi-modal rollers 102*a* and 102*c* on one shaft 302 and the bi-modal rollers 102*b* and 102*d* on the shaft 304.

In block 520, the web tracking system 100 compensates for a purely stick condition and compensates for a purely slip condition of the surface contact between one or more films and one or more bi-modal rollers. In this operation, one or more pairs of cooperating bi-modal rollers rotate about their respective axes parallel to each other and without contacting each other. For example, a first bi-modal roller 102*a* rotates about the shaft 302, and a second bi-modal roller 102*b* rotates about the shaft 304 independently from the first bi-modal roller 102*a*. As each bi-modal roller includes an outer surface having a convex surface and a concave surface, different types of surfaces of the rollers 102*a*-102*b* face each other at different times. That is, in the pair of cooperating rollers 102*a*-102*b*, during a revolution, the concave half 402 of the first roller 102*a* can face the convex half 404 of the second roller 102*b* at one angular position or at one time of the revolution, and then at another time or another angular position of that revolution, the concave half 402 of the first roller 102*a* can face the concave half 402 (i.e., same type of surface) of the second roller 102*b*. In some embodiments, multiple pairs of cooperating bi-modal rollers can rotate about their axes. Note that portions of the films 110-112 can squeeze against each other in surface-to-surface contact, forming a pinch. The surface-to-surface contact between the portions of the films 110-112 may occur wherever the outer surface of one roller 102*a* is closest to the outer surface of its cooperating roller 102*b*. As a non-limiting example, a pinch may occur in the gap between a pair of cooperating bi-modal rollers.

In block 530, the web tracking system 100 uses a pinch to pull the banknote in a linear direction toward a banknote recycler drum 202. For example, portions of the films 110-112 grip opposite sides of the banknote in between the surfaces of the films that form the pinch and pull the banknote towards the banknote recycler drum 202. The direction indicated by the arrow 108 could correspond to the direction of pulling the banknote towards the banknote recycler drum 202.

Note that the web tracking system 100 can perform the method 500 in a reverse manner in order to remove a banknote from the banknote recycler drum and output the banknote via the banknote recycler interface 106. The opposite direction of direction of the arrow 108 could correspond to the direction of removing the banknote from the banknote recycler drum 202, or outputting the banknote from the banknote recycler vial the interface 106.

Figure 7:
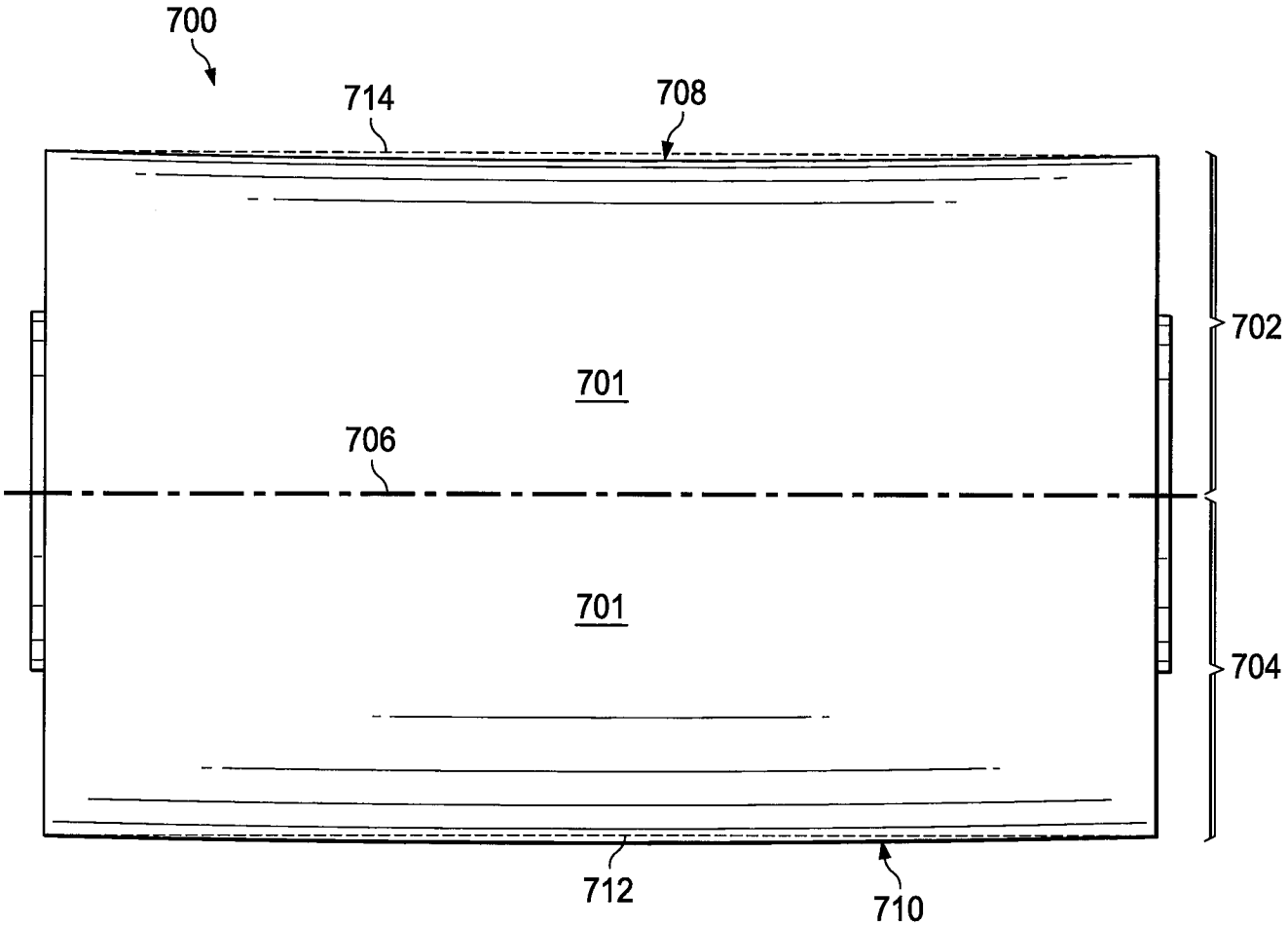
FIG. 7 illustrates an example smooth bi-modal roller in accordance with this disclosure.

FIG. 7 illustrates an example smooth bi-modal roller 700 in accordance with this disclosure. The embodiment of the bi-modal roller 700 shown in FIG. 7 is for illustration only. Other embodiments could be used without departing from the scope of this disclosure.

Note that bi-modal roller 700 of FIG. 7 could be the same as or similar to corresponding bi-modal rollers 102*a*-102*d* and 104*a*-104*d* in FIGS. 1A-1E, or could be the same as or similar to corresponding bi-modal roller 400 in FIG. 4. These components in FIG. 7 can operate in the same or similar manner as the corresponding components in FIGS. 1 and 4.

As shown in FIG. 7, the bi-modal roller 700 includes a round cylindrical structure with a center bore. The outer surface, namely, the rolling outer surface 701 of the bi-modal roller 700 includes a concave portion 702 and another portion that is a convex portion 704. As shown, within both the concave portion 702 and within the convex portion 704, the rolling outer surface 701 is smooth, namely without castellations, without notches, and without recesses. The bi-modal roller 700 rotates about its longitudinal axis 706.

Within the concave portion 702, the rolling outer surface 701 includes the concave curve 708, such as a single concave curve. In other embodiments, the rolling outer surface 701 within the concave portion 702 could include multiple concave curves.

Within the convex portion 704, the rolling outer surface 701 includes the convex curve 710, such as a single convex curve. In other embodiments, the rolling outer surface 701 within the convex portion 704 could include multiple convex curves. As a comparison to the single convex curve 710, a dashed straight horizontal line 712 is shown from one base end of the bi-modal roller 700 to the other base end of the convex portion 704 of the bi-modal roller. Similarly, as a comparison to the single concave curve, a dashed straight horizontal line 714 is shown from one base end of the bi-modal roller 700 to the other base end of the concave portion 702 of the bi-modal roller.

Figure 8:
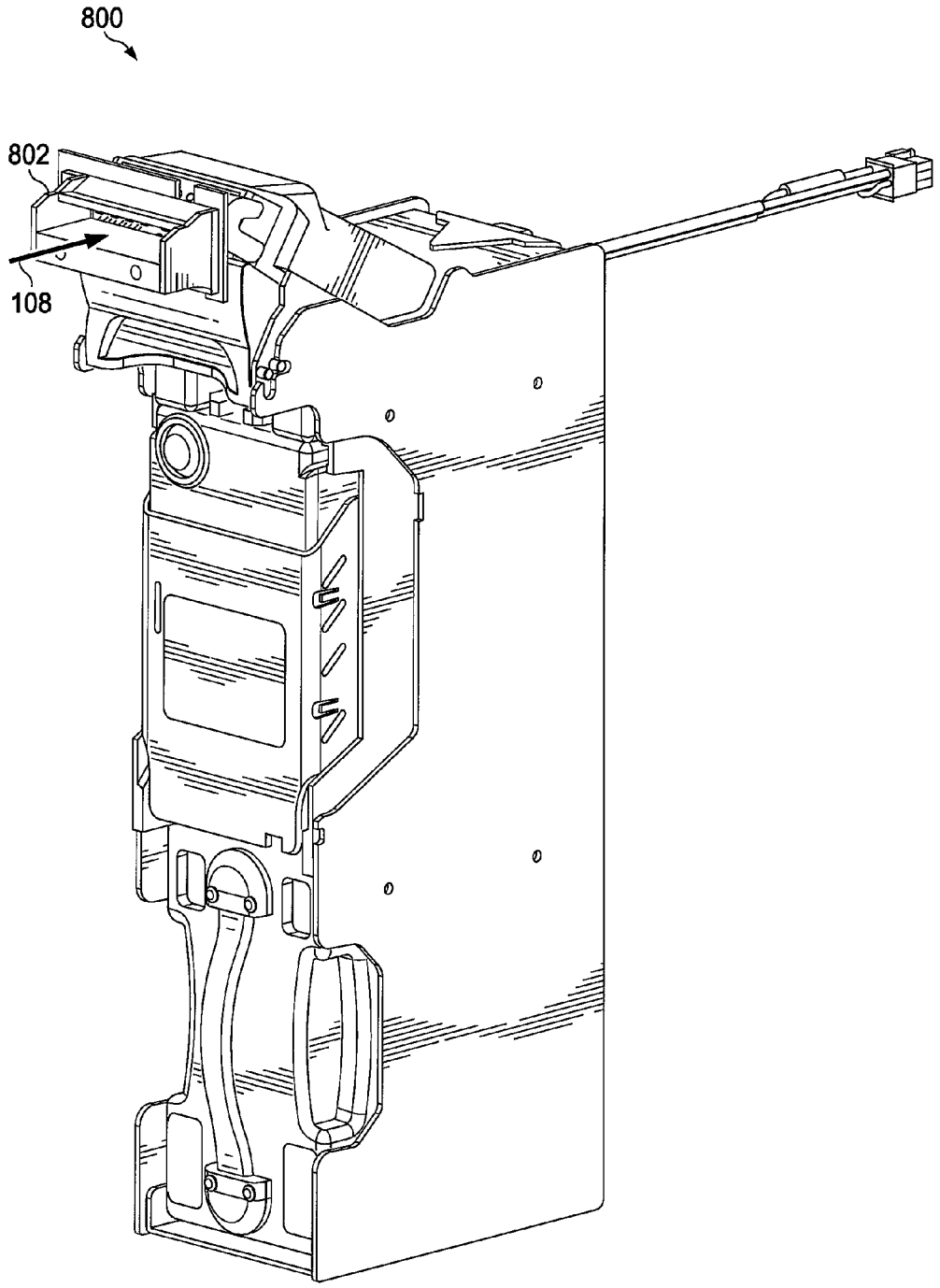
FIG. 8 illustrates an example banknote recycler in accordance with this disclosure.

FIG. 8 illustrates an example banknote recycler 800 in accordance with this disclosure. The banknote recycler 800 includes the web tracking system 100, and can further include a banknote acceptor 802 (for example, a banknote validator) with a slot through with a user may insert a banknote in the direction of an arrow 108.

Figure 9:
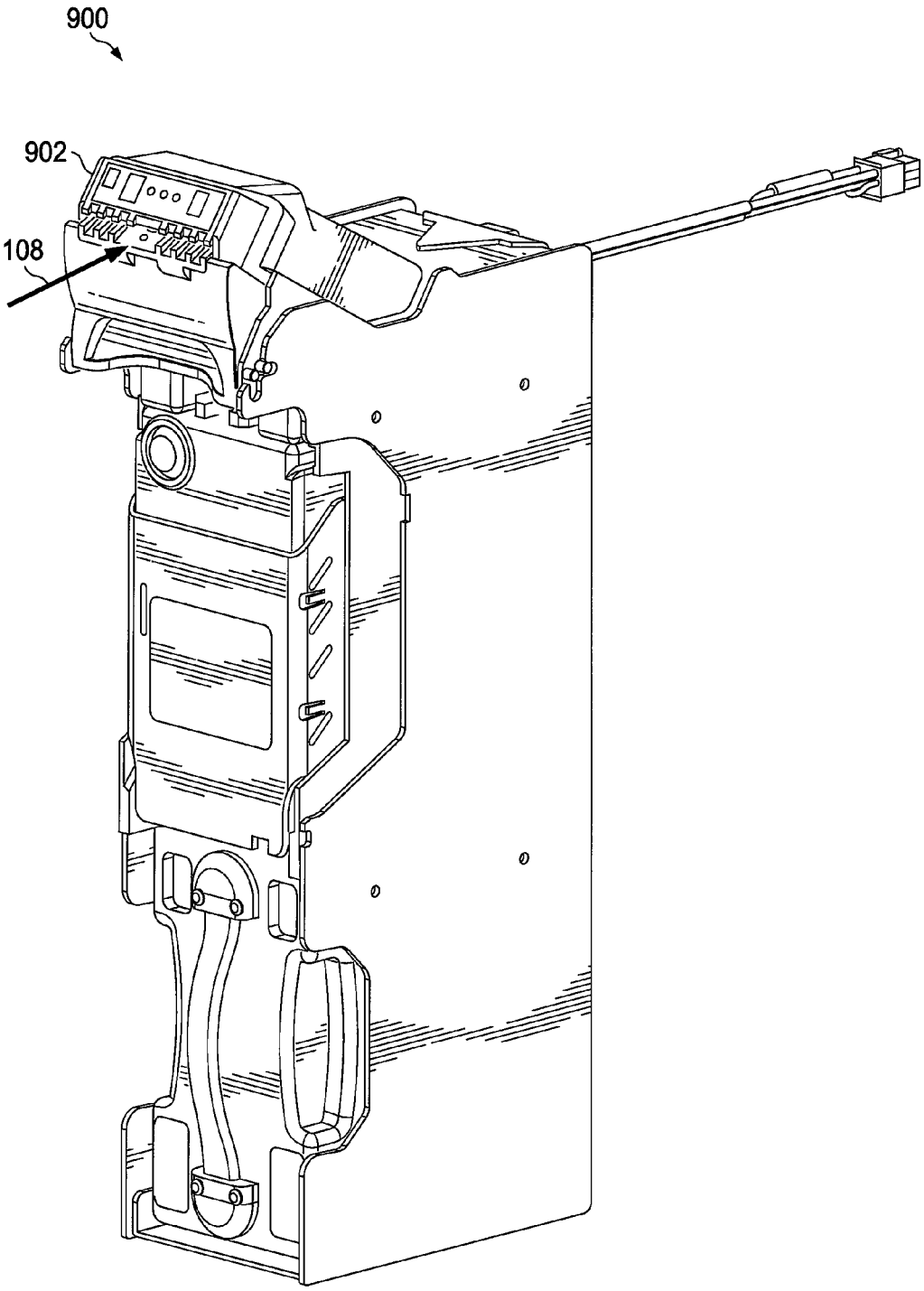
FIG. 9 illustrates an example banknote recycler in accordance with this disclosure.

FIG. 9 illustrates an example banknote recycler 900 in accordance with this disclosure. The embodiment of the banknote recycler 900 shown in FIG. 9 is for illustration only. Other embodiments could be used without departing from the scope of this disclosure.

Note that banknote recycler 900 of FIG. 9 could be the same as or similar to the corresponding banknote recycler 800 in FIG. 8. These components in FIG. 9 can operate in the same or similar manner as the corresponding components in FIG. 8. That is, the banknote recycler 900 includes the web tracking system 100, and can further include a banknote acceptor 902 (for example, a banknote validator) with a slot through with a user may insert a banknote in the direction of an arrow 108.

Although this disclosure has been described with respect to various embodiments, various changes and modifications may be suggested to one skilled in the art. It is intended that this disclosure encompass such changes and modifications as fall within the scope of the appended claims.

What is claimed is:

1. An apparatus comprising:

a bi-modal roller configured to rotate about a longitudinal axis of the bi-modal roller, the bi-modal roller comprising two ends and a rolling outer surface divided into a convex portion and concave portion, wherein the concave portion includes at least one concave curve extending longitudinally between the two ends and is configured to, when a film physically contacts the concave portion, affect translation of the film in response to a stick condition or a slip condition, and wherein the convex portion includes at least one convex curve extending longitudinally between the two ends and is configured to, when the film physically contacts the convex portion, affect translation of the film in response to a stick condition or a slip condition.

2. The apparatus of claim 1, wherein at least one of:

the convex portion includes a plurality of castellations, or the concave portion includes the plurality of castellations; and wherein the plurality of castellations form the at least one convex curve or the at least one concave curve.

3. The apparatus of claim 1, wherein the rolling outer surface is smooth.

4. The apparatus of claim 1, wherein the bi-modal roller is hollow.

5. The apparatus of claim 1, wherein the bi-modal roller is solid.

6. The apparatus of claim 1, wherein a radius of the at least one concave curve and a radius the at least one convex curve each vary in length to a center bore of the bi-modal roller.

7. The apparatus of claim 1, wherein:

the convex portion includes a positive number of convex portions;

the concave portion includes a positive number of concave portions; and wherein a ratio of a percentage of the rolling outer surface occupied by the number of concave portions to a percentage of the rolling outer surface occupied by the number of convex portions is within a range.

8. The apparatus of claim 7, wherein the ratio is one.

9. The apparatus of claim 7, wherein the number of concave portions is one, and wherein the number of convex portions is one.

10. A system comprising:

first and second bimodal rollers forming a pair of bi-modal rollers, each bi-modal roller configured to rotate about a longitudinal axis of the bi-modal roller, each bi-modal roller comprising two ends and a rolling outer surface divided into a convex portion and a concave portion, wherein the concave portion includes at least one concave curve extending longitudinally between the two ends and is configured to, when a film physically contacts the concave portion, affect translation of the film in response to a stick condition or a slip condition, and wherein the convex portion includes at least one convex curve extending longitudinally between the two ends and is configured to, when the film physically contacts the convex portion, affect translation of the film in response to a stick condition or a slip condition, wherein the pair of bi-modal rollers are configured to independently rotate without contacting each other.

11. The system of claim 10, wherein at least one of:

the convex portion includes a plurality of castellations, or the concave portion includes the plurality of castellations; and wherein the plurality of castellations form the at least one convex curve or the at least one concave curve.

12. The system of claim 10, wherein the bi-modal roller is smooth.

13. The system of claim 10, wherein the bi-modal roller is hollow.

14. The system of claim 10, wherein the hi-modal roller is solid.

15. The system of claim 10, wherein:

the convex portion includes a positive number of convex portions;

the concave portion includes a positive number of concave portions; and wherein a ratio of a percentage of the rolling outer surface occupied by the number of concave portions to a percentage of the rolling outer surface occupied by the number of convex portions is substantially one.

16. A web-tracking system comprising:

first and second bi-modal rollers forming a pair of cooperating bi-modal rollers, the pair of cooperating bi-modal rollers configured to independently rotate without contacting each other, each bi-modal roller configured to rotate about a longitudinal axis of the bi-modal roller, each bi-modal roller comprising two ends and a rolling outer surface divided into a convex surface portion and a concave surface portion, wherein the concave portion includes at least one concave curve extending longitudinally between the two ends and is configured to, when a film physically contacts the concave portion, affect translation of the film in response to a stick condition or a slip condition, and wherein the convex portion includes at least one convex curve extending longitudinally between the two ends and is configured to, when the film physically contacts the convex portion, affect translation of the film in response to a stick condition or a slip condition; and at least one film wrapped around at least part of each of the rollers in the pair of cooperating bi-modal rollers, the at least one film including the film, wherein the at least one film is configured to move a banknote in multiple directions based on different rotations of the pair of cooperating bi-modal rollers.

17. The web-tracking system of claim 16, further comprising:

one or more pairs of cooperating bi-modal rollers; and in order to move the banknote in the multiple directions, a controller configured to control:

a speed and direction of rotation of first and second bi-modal rollers of each pair of the one or more pairs of cooperating bi-modal rollers by controlling a direction of rotation of motors coupled to each pair of the one or more pairs of cooperating bi-modal rollers, wherein a first direction of rotation of the motors causes the at least one film to move the banknote in one direction associated with intake of the banknote, and wherein a second direction of rotation of the motors that is opposite to the first direction of rotation of the motors causes the at least one film to move the banknote in an opposite direction associated with removal the banknote.

18. The web-tracking system of claim 16, wherein at least one of:

the convex portion includes a plurality of castellations, or the concave portion includes the plurality of castellations; and wherein the plurality of castellations form the at least one convex curve or the at least one concave curve.

19. The web-tracking system of claim 16, wherein the bi-modal roller is hollow.

20. The web-tracking system of claim 16, wherein the bi-modal roller is smooth.

21. The web-tracking system of claim 20, wherein the bi-modal roller is solid.

* * * * *